US008616719B1

(12) United States Patent
Barze

(10) Patent No.: US 8,616,719 B1
(45) Date of Patent: Dec. 31, 2013

(54) LIGHTED SAFETY VEST DEVICE

(76) Inventor: Joan Barze, Ponchatoula, LA (US)

( * ) Notice: Subject to any disclaimer, the term of this patent is extended or adjusted under 35 U.S.C. 154(b) by 0 days.

(21) Appl. No.: 13/545,401

(22) Filed: Jul. 10, 2012

(51) Int. Cl.
*F21V 21/108* (2006.01)

(52) U.S. Cl.
USPC ..... 362/108; 362/103

(58) Field of Classification Search
USPC ..... 362/108, 103, 297, 249, 346, 184, 235, 362/105, 800; 2/69, 102, 103
See application file for complete search history.

(56) References Cited

U.S. PATENT DOCUMENTS 4,328,533 A * 5/1982 Paredes ..... 362/108
5,070,436 A * 12/1991 Alexander et al. ..... 362/108
5,249,106 A * 9/1993 Barnes et al. ..... 362/108
5,879,076 A 3/1999 Cross
6,517,214 B1 2/2003 Mitchell, Jr. et al.
6,906,472 B2 6/2005 Wong
7,144,127 B2 12/2006 Golle et al.
2002/0152533 A1 * 10/2002 Lesley ..... 2/102
2007/0053179 A1 * 3/2007 Pang et al. ..... 362/103

* cited by examiner

*Primary Examiner* — Anne Hines

(57) ABSTRACT

The lighted safety vest device provides a flexible material that can be laid flat out or even folded if desired, easing transport and storage and also providing for most comfortable fit. The embedded circuitry is flexible and connects the control to the embedded plurality of lights. Preferably LED lights are importantly arranged in sets with rows of three, with a row width of about 3½ inches. Rows are arranged in side-by-side columns with column heights of about 15 inches. Rows of the front proximal to the first end are disposed on either side of the front division. A single grouping of three columns with three rows in each is arranged centrally most proximal to the second end. Row width and set arrangements provide visibility from virtually any angle by which a user may be viewed. Set size also provides distant viewing of a user.

3 Claims, 4 Drawing Sheets

LIGHTED SAFETY VEST DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Safety vests are typically worn by those needing to be seen. Such workers might be highway maintenance workers, sports officials, or any number of others performing a duty in which their visibility is important. The device adheres to visibility principles regarding size of illumination field and lighting.

FIELD OF THE INVENTION

The lighted safety vest device relates to safety vests, such as reflective vests for example, and more especially to a pliable safety vest with embedded lighting having continual and flash lighting capabilities.

SUMMARY OF THE INVENTION

The general purpose of the lighted safety vest device, described subsequently in greater detail, is to provide a lighted safety vest device which has many novel features that result in an improved lighted safety vest device which is not anticipated, rendered obvious, suggested, or even implied by prior art, either alone or in combination thereof.

To attain this, the lighted safety vest device comprises a flexible material that can be laid flat out or even folded if desired, easing transport and storage and also providing for most comfortable fit. The circuitry embedded within the vest device is flexible and connects the control to the plurality of lights. The circuitry and lights are importantly embedded, with lights aimed outwardly from the top. Experimentation and knowledge of visibility factors dictate that the lights, which may preferably be LED's, may importantly be arranged in sets with rows of three, with a row width of about 3½ inches. Additionally, rows may be arranged in side-by-side columns with column heights of about 15 inches. Rows of the front proximal to the first end are disposed on either side of the front division. A single grouping of three columns with three rows in each is arranged centrally most proximal to the second end. In use, the front rows and columns most proximal to the first end are thereby worn on a user's front torso. The rows and columns most proximal to the second end position one single set on a user's back torso. Row width and set arrangements provide visibility from virtually any angle by which a user may be viewed. Set size also provides distant viewing of a user. The control is importantly positioned on the bottom proximal to one side of the first end for accessibility and to ensure that the control is protected. The control provides off position, constant on position, and a flash position wherein the lights flash.

The division is extended from the first end to the neck cutout and greatly eases vest donning and doffing. The division may employ any appropriate clothing fastening means. The sides of the vest device remain open until selectively and removably fastened. This feature too contributes to portability, storage, and ease of use. Fastening means may include but are not limited to hook and loop, snaps, zippers, buttons, and other appropriate releasable fastening means.

Thus has been broadly outlined the more important features of the improved lighted safety vest device so that the detailed description thereof that follows may be better understood and in order that the present contribution to the art may be better appreciated.

An object of the lighted safety vest device is to provide a safety vest with integral lighting.

Another object of the lighted safety vest device is to provide a safety vest with lighting sufficient to be easily visible.

A further object of the lighted safety vest device is to provide an easily donned lighted safety vest.

An added object of the lighted safety vest device is to provide an easily doffed lighted safety vest.

And, an object of the lighted safety vest device is to a reflective bead surrounding a neck and a center front for increased visibility.

These together with additional objects, features and advantages of the improved lighted safety vest device will be readily apparent to those of ordinary skill in the art upon reading the following detailed description of presently preferred, but nonetheless illustrative, embodiments of the improved lighted safety vest device when taken in conjunction with the accompanying drawings.

DETAILED DESCRIPTION OF THE DRAWINGS

With reference now to the drawings, and in particular FIGS. 1 through 5 thereof, the principles and concepts of the lighted safety vest device generally designated by the reference number 10 will be described.

Figure 1:
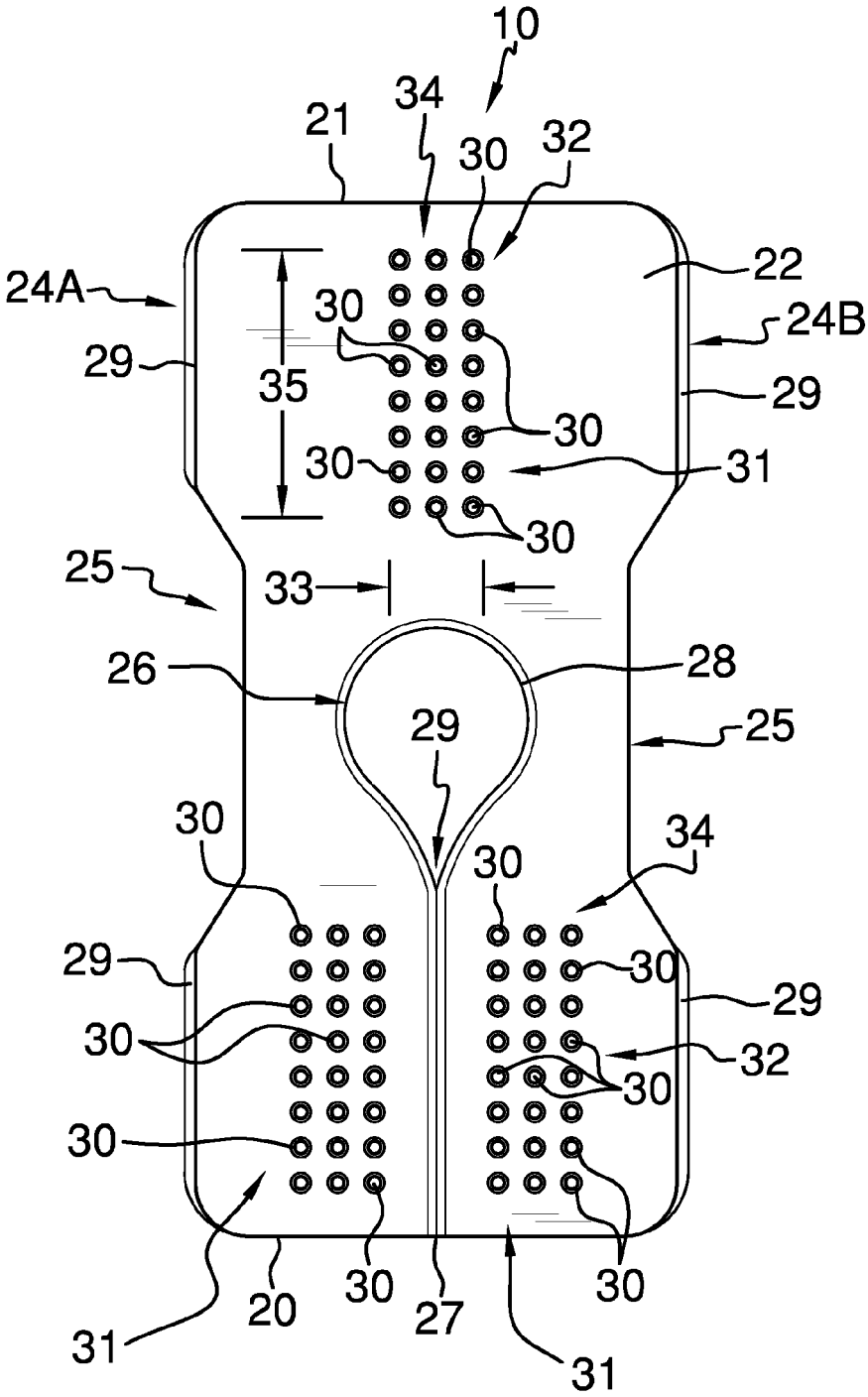
FIG. 1 is a top plan view.

Referring to FIG. 1, the device 10 is fully pliable. The device 10 partially comprises a first end 20 spaced apart from a second end 21, a first side 24A spaced apart from a second side 24B, a top 22 and a bottom 23. A recess 25 is disposed centrally in each side. The recesses 25 are configured to fit around a user's shoulders and arms. A neck cutout 26 is disposed about centrally between the first end 20 and the second end 21. A division 27 is extended from the neck cutout 26 to the first end 20. A reflective bead 28 borders the neck cutout 26 and the division 27. A fastening means 29 is configured to selectively and removably fasten the division 27 and the first side 24A to the second side 24B. A plurality of embedded lights 30 faces outwardly from the top 22. The lights 30 are disposed in sets 31 comprising a plurality of rows 32. The rows 32 each number 8. Each set 31 further comprises columns 34. Columns 34 within each set 31 number 3. Each row 32 has a lateral row width 33 of about 3½ inches. Each column 34 has a column height 35 of about 15 inches. One set 31 is disposed on an either side of the division 27. One set 31 is disposed centrally, proximal to the second end 21.

Figure 2:
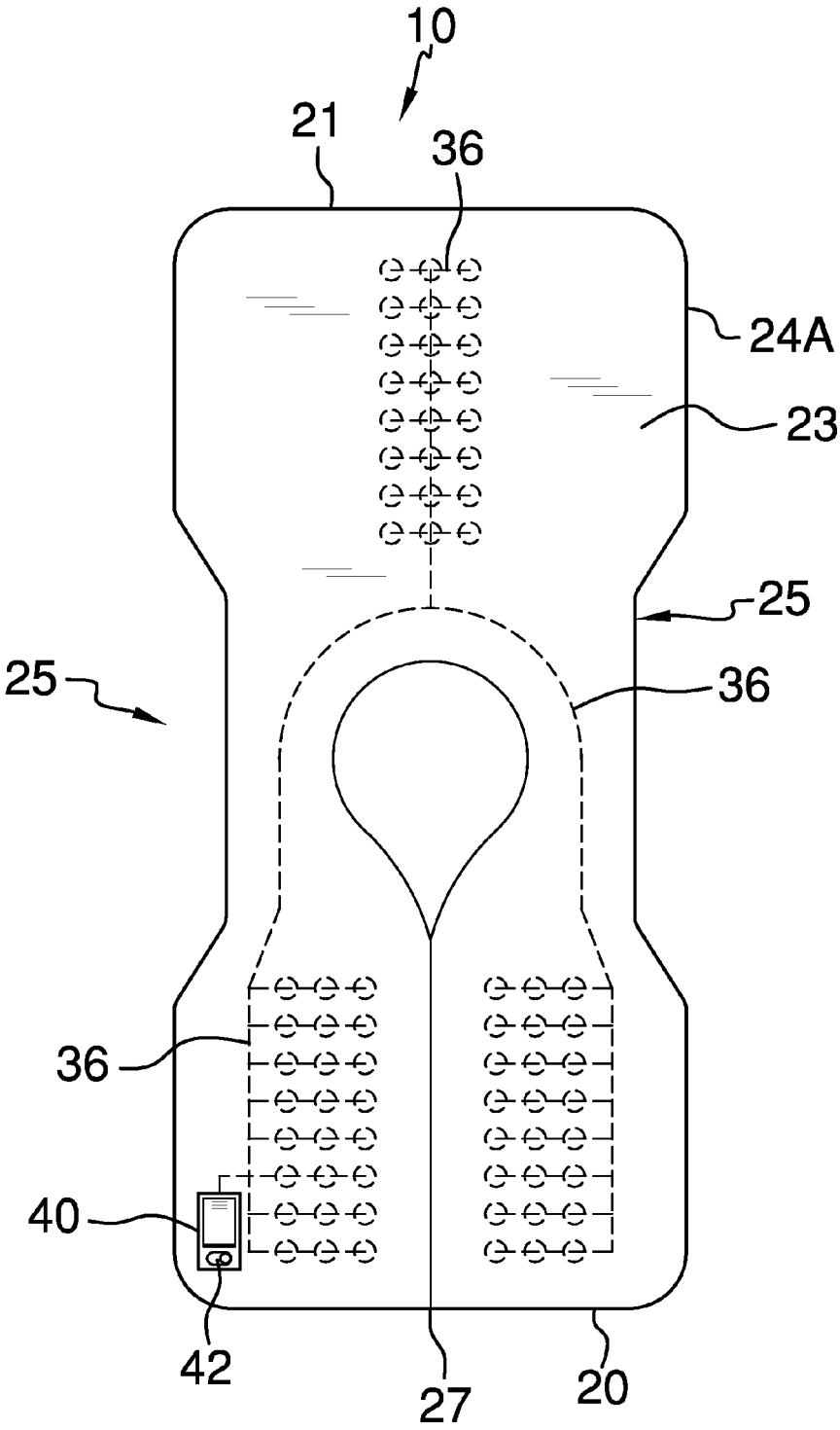
FIG. 2 is a bottom plan view.

Referring to FIG. 2, a circuitry 36 connects the lights 30.

Figure 3:
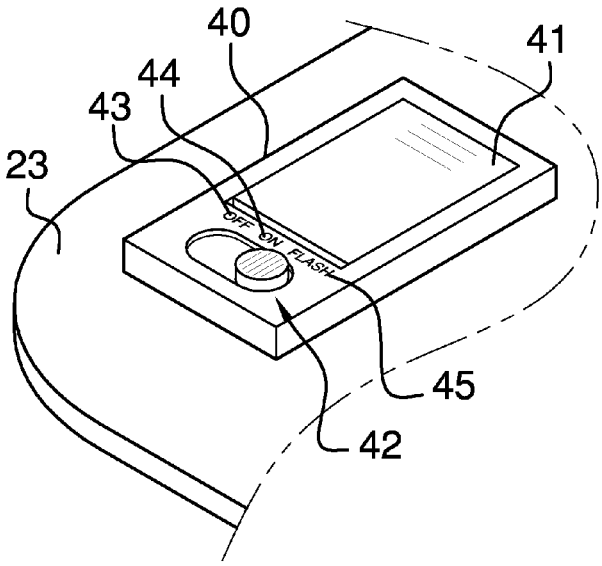
FIG. 3 is a perspective view of the control module.

Referring to FIG. 3, a control 40 is disposed on the bottom 23 proximal to the first end 20. The control 40 is in communication with the circuitry 36. The control 40 further comprises a switch 42 having an off position 43, an on position 44, and a flash position 45. A battery pack 41 within the control 40 is in communication with the switch 42.

Figure 4:
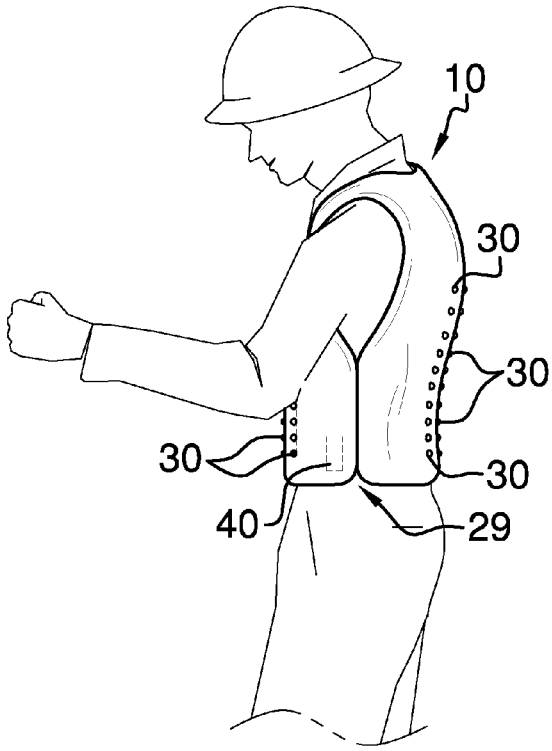
FIG. 4 is an in-use lateral elevation view.

Referring to FIG. 4, a user has donned the device 10 and fastened the first side 24A to the second side 24B. Lights 30 are strategically arranged to be visible from any direction of user exposure.

Figure 5:
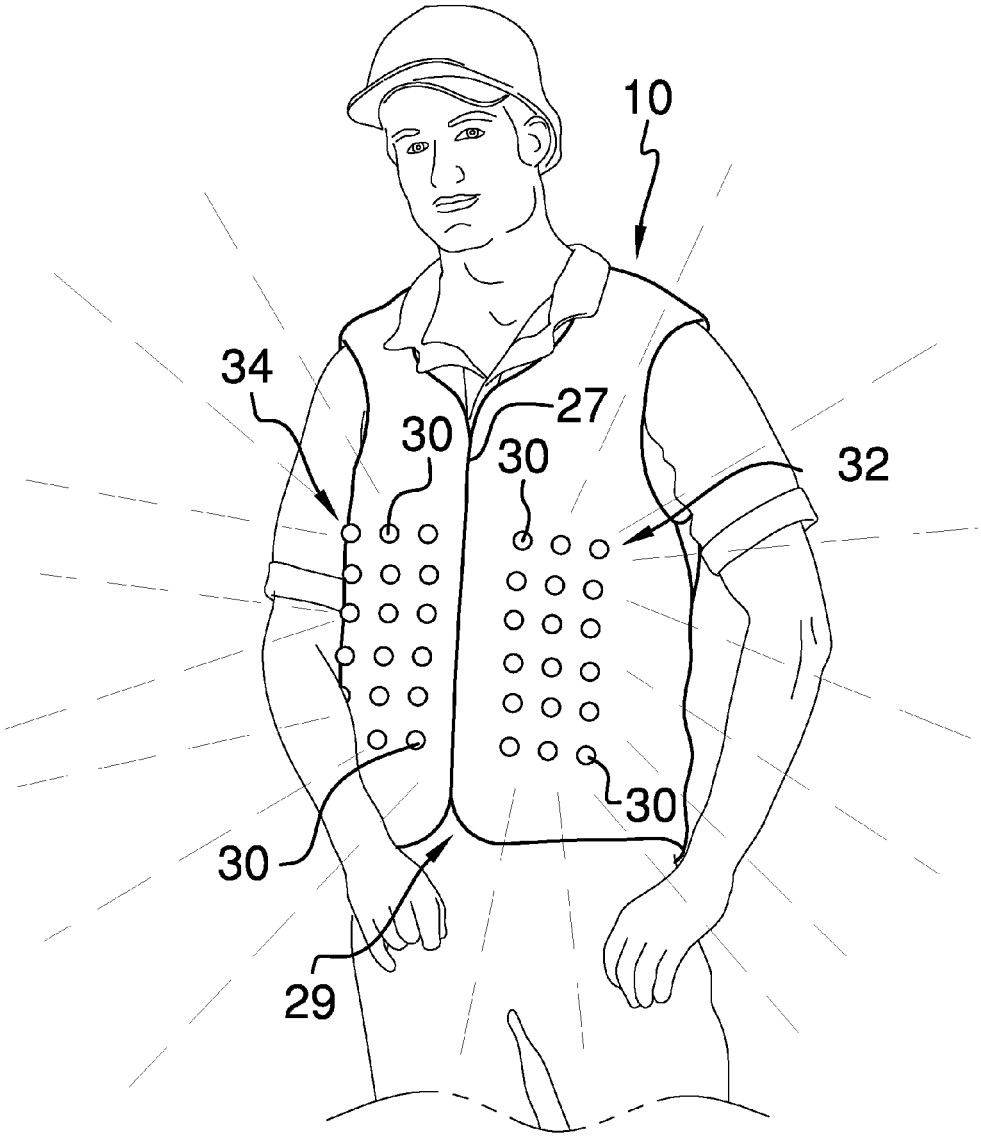
FIG. 5 is an in-use front perspective view.

Referring to FIG. 5, the user has joined the division 27 via the fastening means 29 after donning the device 10.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the lighted safety vest device may be used.

What is claimed is:

1. A lighted safety vest device comprising, in combination:

a first end spaced apart from a second end, a pliable first side spaced apart from a pliable second side, a top and a bottom;

a recess disposed centrally in each side, the recesses configured to fit around a user's shoulders and arms;

a neck cutout disposed about centrally between the first end and the second end;

a division extended from the neck cutout to the first end;

a reflective bead bordering the neck cutout and the division;

a fastening means configured to selectively fasten the division and the first side to the second side;

a plurality of embedded lights facing outwardly from the top, the lights disposed in sets, each set comprising a plurality of rows and a plurality of columns, a set disposed on an either side of the division, a set disposed centrally, proximal to the second end;

a circuitry connecting the lights;

a control disposed on the bottom proximal to the first end, the control in communication with the circuitry, the control further comprising:

a switch having an off position, an on position, and a flash position;

a battery pack in communication with the switch.

2. A lighted safety vest device comprising, in combination:

a first end spaced apart from a second end, a pliable first side spaced apart from a pliable second side, a top and a bottom;

a recess disposed centrally in each side, the recesses configured to fit around a user's shoulders and arms;

a neck cutout disposed about centrally between the first end and the second end;

a division extended from the neck cutout to the first end;

a reflective bead bordering the neck cutout and the division;

a fastening means configured to selectively fasten the division and the first side to the second side;

a plurality of embedded lights facing outwardly from the top, the lights disposed in sets, each set comprising a plurality of rows and a plurality of columns, the rows comprising rows of 8, the columns comprising columns of 3, a set disposed on an either side of the division, a set disposed centrally, proximal to the second end;

a circuitry connecting the lights;

a control disposed on the bottom proximal to the first end, the control in communication with the circuitry, the control further comprising:

a switch having an off position, an on position, and a flash position;

a battery pack in communication with the switch.

3. A lighted safety vest device comprising, in combination:

a first end spaced apart from a second end, a pliable first side spaced apart from a pliable second side, a top and a bottom;

a recess disposed centrally in each side, the recesses configured to fit around a user's shoulders and arms;

a neck cutout disposed about centrally between the first end and the second end;

a division extended from the neck cutout to the first end;

a reflective bead bordering the neck cutout and the division;

a fastening means configured to selectively fasten the division and the first side to the second side;

a plurality of embedded lights facing outwardly from the top, the lights disposed in sets, each set comprising a plurality of rows and a plurality of columns, the rows comprising rows of 8, the columns comprising columns of 3, each row having a laterally dimensioned row width of about 3½ inches, each column having a column height of about 15 inches, a set disposed on an either side of the division, a set disposed centrally, proximal to the second end;

a circuitry connecting the lights;

a control disposed on the bottom proximal to the first end, the control in communication with the circuitry, the control further comprising:

a switch having an off position, an on position, and a flash position;

a battery pack in communication with the switch.

* * * * *